US010054392B2

(12) United States Patent
Maroney

(10) Patent No.: US 10,054,392 B2
(45) Date of Patent: Aug. 21, 2018

(54) GRIP SLEEVE FOR FIREARM

(71) Applicant: Samuel P. Maroney, Springfield, VA (US)

(72) Inventor: Samuel P. Maroney, Springfield, VA (US)

( * ) Notice: Subject to any disclaimer, the term of this patent is extended or adjusted under 35 U.S.C. 154(b) by 0 days.

(21) Appl. No.: 15/137,822

(22) Filed: Apr. 25, 2016

(65) Prior Publication Data

US 2016/0313086 A1 Oct. 27, 2016

Related U.S. Application Data

(60) Provisional application No. 62/152,851, filed on Apr. 25, 2015.

(51) Int. Cl.
*F41C 23/00* (2006.01)
*F41C 23/10* (2006.01)

(52) U.S. Cl.
CPC ..... *F41C 23/10* (2013.01)

(58) Field of Classification Search
CPC ..... F41A 23/10
USPC ..... 89/1.42; 42/71.02; 16/430, 431; 74/551.9; 81/22; D22/108
See application file for complete search history.

(56) References Cited

U.S. PATENT DOCUMENTS 1,751,780 A 3/1930 Weiger
2,437,404 A 3/1948 Robinson
2,831,948 A 4/1958 Fraser
3,189,069 A * 6/1965 Stowell ..... B25G 1/00 16/421
3,410,017 A 11/1968 Wilson
3,614,100 A 10/1971 Spitz
3,815,270 A 6/1974 Pachmayr
4,098,506 A 7/1978 Gaiser
4,440,835 A 4/1984 Vignaud
4,660,311 A 4/1987 Breitfeld et al.
4,691,986 A 9/1987 Aberson, Jr. et al.
5,125,286 A 6/1992 Wilson
D330,837 S 11/1992 Harmon
5,199,706 A 4/1993 Chen
5,231,237 A 7/1993 Cupp
D349,938 S 8/1994 Hogue et al.
D351,448 S * 10/1994 Fisher ..... 42/71.02
D351,638 S * 10/1994 Scott ..... 42/71.02
5,406,731 A 4/1995 Stevens
5,469,601 A 11/1995 Jackson
(Continued)

OTHER PUBLICATIONS

TUFF1 Gun Grip Covers. <https://web.archive.org/web/20130607044526/http://www.tuff1.com/gun-grips-tuff1-death-grip-the-worlds-best-universal-gun-grip>. Jun. 7, 2013.*
(Continued)

*Primary Examiner* — Gabriel J. Klein
(74) *Attorney, Agent, or Firm* — LaBatt, LLC

(57) ABSTRACT

Grip sleeves for firearm grips are disclosed. The grip sleeve may include a hollow body formed of an elastic material. The hollow body may include an inner contact surface configured to be placed around a grip of the firearm, and an outer contact surface surrounding the inner contact surface. The grip sleeve for the firearm may also include a ridge portion extending from the inner contact surface into an interior space of the hollow body. The ridge portion may extend along a height of the hollow body.

20 Claims, 7 Drawing Sheets

(56) References Cited

U.S. PATENT DOCUMENTS

| | | | | |
|---|---|---|---|---|
| D375,240 | S | 11/1996 | Campbell | |
| 5,621,834 | A | 4/1997 | Anderson et al. | |
| D393,194 | S | 4/1998 | Hogue et al. | |
| 5,810,525 | A | 9/1998 | Ector, Sr. | |
| D424,775 | S | 5/2000 | Rabinowitz et al. | |
| 6,112,446 | A | 9/2000 | Forster et al. | |
| 6,802,148 | B1 | 10/2004 | Danas | |
| 7,332,238 | B2 | 2/2008 | Montupally et al. | |
| 7,435,186 | B1 * | 10/2008 | Miller | A63B 53/14 473/300 |
| 7,467,489 | B2 | 12/2008 | Gussalli Beretta | |
| 8,857,093 | B2 | 10/2014 | Hogue | |
| 8,950,098 | B2 | 2/2015 | Sims et al. | |
| D733,829 | S | 7/2015 | Chvala | |
| 2004/0107621 | A1 | 6/2004 | Segalle | |
| 2005/0188587 | A1 * | 9/2005 | Danas | F41C 23/10 42/72 |
| 2006/0068148 | A1 * | 3/2006 | Ulrich | A63B 53/14 428/41.8 |
| 2006/0096147 | A1 | 5/2006 | Gussalli Beretta | |
| 2006/0287124 | A1 * | 12/2006 | Han | A63B 53/14 473/300 |
| 2010/0011540 | A1 | 1/2010 | Chen | |
| 2010/0298063 | A1 * | 11/2010 | Gill | A63B 53/14 473/303 |
| 2011/0167698 | A1 * | 7/2011 | Hoguc | F41C 23/10 42/71.02 |
| 2011/0258900 | A1 | 10/2011 | Sims et al. | |
| 2013/0047379 | A1 * | 2/2013 | Zilke | F41B 5/148 16/421 |
| 2015/0082679 | A1 * | 3/2015 | Michal | F41A 21/24 42/71.01 |
| 2015/0300775 | A1 | 10/2015 | Combs | |

OTHER PUBLICATIONS

Botach, "FAB Defense FN FAL Ergonomic Pistol Grip," printed Apr. 25, 2016, 6 pages, https://www.botach.com/fab-defense-fn-fal-ergonomic-pistol-grip/.

Pratt, M., U.S. Appl. No. 29/562,353, Non-Final Rejection1, dated Jun. 29, 2017, 16 pages.

* cited by examiner

GRIP SLEEVE FOR FIREARM

REFERENCE TO RELATED APPLICATIONS

The current application claims the benefit of U.S. Provisional Application No. 62/152,851, which was filed on Apr. 25, 2015, and which is hereby incorporated by reference.

TECHNICAL FIELD

The disclosure relates generally to firearms, and more particularly, to a firearm grip.

BACKGROUND ART

There are several rubberized grip attachments in the firearms market that offer increased grip, by utilizing soft rubbers, finger grooves or large padded sleeves of soft rubbers. However, the majority of these conventional grip attachments are for improving the grip of the user's primary hand or firing hand, which includes the trigger finger.

SUMMARY OF THE INVENTION

The inventor recognizes that existing grip attachments do not focus on improving the grip and/or limiting forward movement of the user's non-firing hand. The inventor proposes that Limiting the forward movement of a user's non-firing hand can help improve the stability of the firearm and/or improve the shooting accuracy of the firearm user. This is especially true where the firearm is a handgun that may require the user to grip a smaller and/or shortened grip or handle with both hands before shooting the firearm.

Aspects of the invention provide a grip sleeve including a hollow grip body (e.g., tube) with a large abrupt ridge portion. The grip body and/or ridge portion can be made of an elastic material configured to be placed around a grip of various firearms. The grip sleeve may enhance grip and retention of the firearm within the user's hands during use. Specifically, utilizing the ridge on a grip of a firearm may prevent and/or minimize forward movement of the non-firing or support hand when shooting the firearm. Minimizing and/or eliminating the forward movement of a user's non-firing hand may greatly enhance the user's ability to maintain control, accuracy, and/or consistent grip pressure while operating the firearm. The ridge portion may also allow the user to experience faster target acquisition, and faster follow up shots when the grip sleeve is placed around the grip of a firearm.

A first aspect of the invention provides a grip sleeve for a firearm. The grip sleeve may include a hollow body formed of an elastic material. The hollow body may include an inner contact surface configured to be placed around a grip of the firearm, and an outer contact surface surrounding the inner contact surface. The grip sleeve for the firearm may also include a ridge portion extending from the inner contact surface into an interior space of the hollow body. The ridge portion may extend along a height of the hollow body.

A second aspect of the invention provides a grip sleeve for a firearm. The grip sleeve may include a hollow body formed from an elastic material. The hollow body may be configured to be placed around at least a portion of an angled grip of the firearm. The grip sleeve may also include a ridge portion extending from an interior side of the hollow body. The ridge portion may be configured to contact a side of the angled grip of the firearm, and the ridge portion may have a similar orientation as the angled grip of the firearm when the hollow body is placed around the angled grip of the firearm.

A third aspect of the invention provides a firearm including a grip and a grip sleeve surrounding at least a portion of the grip. The grip sleeve may include a hollow body formed of an elastic material. The hollow body may include an inner contact surface configured to be placed around a grip of the firearm, an outer contact surface surrounding the inner contact surface, and a ridge portion extending along a height of the hollow body. The ridge portion may be located on a non-firing hand side of the grip and be held in place by the grip sleeve.

The illustrative aspects of the invention are designed to solve one or more of the problems herein described and/or one or more other problems not discussed.

BRIEF DESCRIPTION OF THE DRAWINGS

These and other features of the disclosure will be more readily understood from the following detailed description of the various aspects of the invention taken in conjunction with the accompanying drawings that depict various aspects of the invention.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide a firearm accessory. More particularly, aspects of the invention provide a grip sleeve for a firearm grip.

As used herein, unless otherwise noted, the term "set" means one or more (i.e., at least one) and the phrase "any solution" means any now known or later developed solution.

Figure 1A:
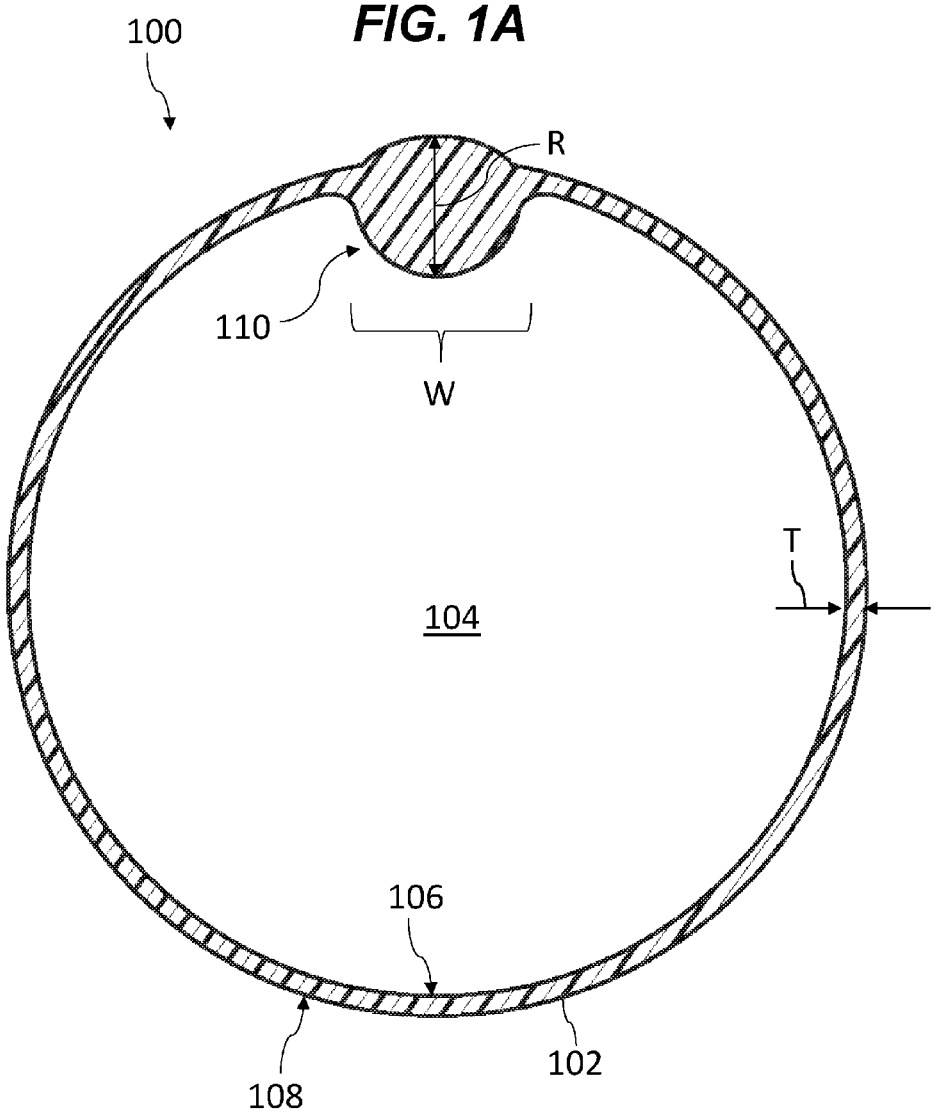
FIG. 1A shows an illustrative top view of a grip sleeve for a firearm, according to an embodiment.
Figure 1B:
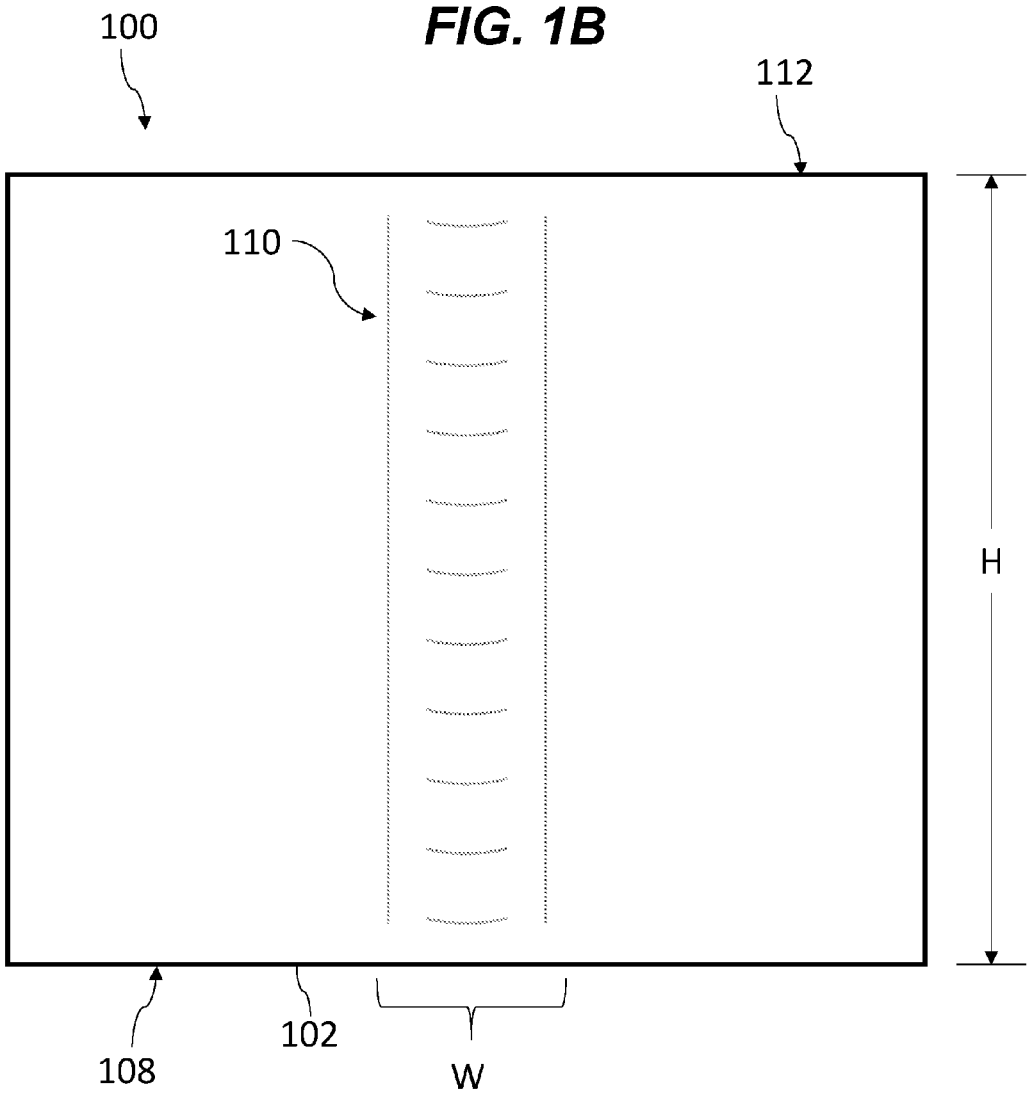
FIG. 1B shows an illustrative side view of the grip sleeve of FIG. 1A, according to an embodiment.

Turning to the drawings, FIGS. 1A and 1B show top and side views, respectively, of a grip sleeve 100 for use in conjunction with various firearms according to an embodiment. As discussed herein, the grip sleeve 100 may be placed around at least a portion of a grip of a firearm to improve the grip of a user's secondary or non-firing hand on the firearm, which may result in improved control, accuracy, and/or consistent grip pressure on the firearm during operating (e.g., shooting or firing).

As shown in FIGS. 1A and 1B, the grip sleeve 100 may include a hollow body 102. Hollow body 102 may be any shape, such as substantially cylindrical, annular and/or tube-shaped, and may include an interior space or opening 104 (see, FIG. 1A) formed substantially through hollow body 102. As shown in FIG. 1A, hollow body 102 may have a substantially uniform thickness (T), except for the ridge portion discussed below in detail. The thickness (T) of hollow body 102 may be a predetermined thickness that may not obstruct and/or substantially change the user's feel of a grip of a firearm when grip sleeve 100 is coupled to and/or placed around the grip. In non-limiting examples, the thickness (T) of hollow body 102 may be in a range of 5 millimeters (mm) or less. In a more particular non-limiting example, the thickness (T) of hollow body 102 is in a range of approximately 0.5 mm to 2 mm. In a still more particular non-limiting example, the thickness (T) is approximately 0.9 mm or less, and more specifically, may be within a range of approximately 0.5 mm to approximately 0.8 mm. Although shown and discussed as having a substantially uniform thickness (T), it is understood that hollow body 102 of grip sleeve may include a varying thickness. As discussed herein, hollow body 102, and specifically interior space 104 formed in and/or through hollow body 102, may receive the grip of a firearm when grip sleeve 100 is coupled to and/or positioned around the grip of the firearm.

Hollow body 102 may include an inner contact surface 106 and an outer contact surface 108. Inner contact surface 106 may substantially surround and/or may be formed by interior space 104, and may be configured to be placed around a grip of a firearm, when grip sleeve 100 is coupled to the firearm. Inner contact surface 106 may also contact the grip of a firearm when grip sleeve 100 is positioned on the firearm, and may compressively press against the grip to temporarily hold and/or secure grip sleeve 100 to the firearm.

Outer contact surface 108 of hollow body 102 may be positioned opposite inner contact surface 106. As shown in FIG. 1A, outer contact surface 108 may also surround inner contact surface 106 and interior space 104 of hollow body 102. When grip sleeve 100, and specifically hollow body 102, is placed around at least a portion of a grip of a firearm, outer contact surface 108 may be substantially exposed. As a result, and as discussed herein, outer contact surface 108 may contact and/or be gripped by a user of the firearm including grip sleeve 100. In a non-limiting embodiment, the inner contact surface 106 may include a contoured surface of facilitate coupling the grip sleeve 100 to the firearm. In another non-limiting embodiment, the outer contact surface 108 may include a contoured surface to improve the grip and/or comfort of the user.

Figure 1C:
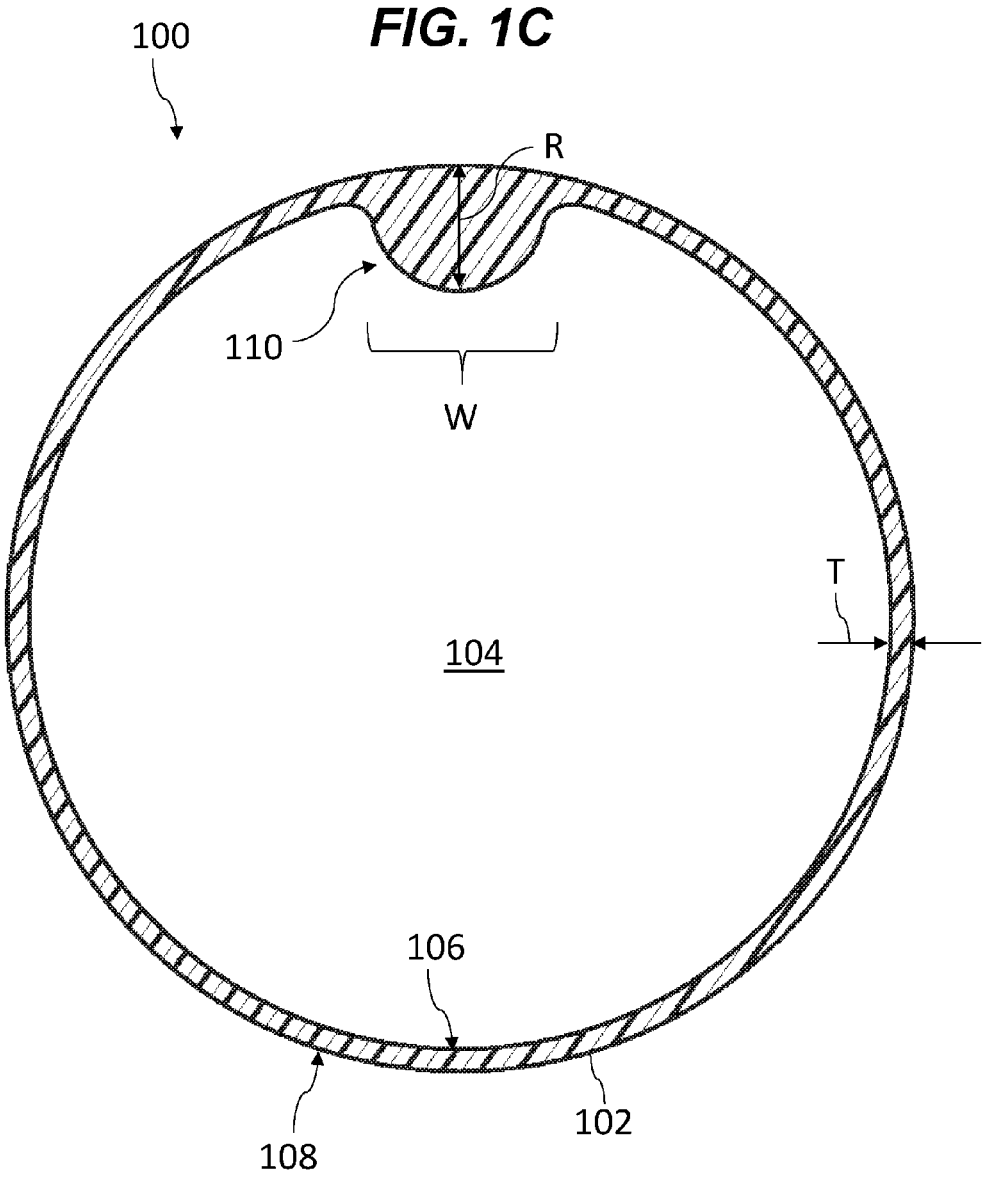
FIG. 1C shows an illustrative top view of a grip sleeve for a firearm, according to another embodiment.

As shown in FIGS. 1A-1C, grip sleeve 100 may also include a ridge portion 110. The ridge portion 110 may be positioned on and/or may extend from inner contact surface 106. In a non-limiting example, ridge portion 110 may be formed integrally with hollow body 102, such that ridge portion and hollow body 102 of grip sleeve 100 is a single, continuous component and/or formed from a single piece of material. As shown in FIG. 1A, ridge portion 110 of grip sleeve 100 may extend and/or protrude at least partially into interior space 104 of hollow body 102. Additionally, as shown in FIG. 1A, the inclusion of ridge portion 110 on grip sleeve 100 may result in a portion of outer contact surface 108 positioned adjacent ridge portion 110 to extend or protrude away from and/or out of plane from the remaining portion of outer contact surface 108. Alternatively, as shown in FIG. 1C, the ridge portion 110 on grip sleeve 100 may extend and/or protrude entirely into interior space 1040 Of hollow body 102 when the grip sleeve 100 is in an unstretched state.

Ridge portion 110 has a thickness (R) significantly greater than a thickness (T) of the hollow body 102. The thickness (R) of ridge portion 110 may be selected to be sufficient to provide additional support and/or grip to the user's non-firing hand, while being sufficiently small so as to not otherwise obstruct the user's feel of a grip of a firearm when grip sleeve 100 is coupled to and/or placed around the grip. In non-limiting examples, the thickness (R) of ridge portion 110 may be in a range of 15millimeters (mm) or less. In a more particular non-limiting example, the thickness (R) of ridge portion 110 is in a range of approximately 8 mm to 13 mm. In a still more particular non-limiting example, the thickness (R) of ridge portion 110 is approximately 9-11 mm. Although shown and discussed as having a substantially uniform thickness (R), it is understood that ridge portion 110 of grip sleeve may include a varying thickness (R).

As shown in FIGS. 1A-1C, ridge portion 110 of grip sleeve 100 may be formed integrally with hollow body 102 such that ridge portion is substantially linear. That is, ridge portion 110 may be formed in a substantially linear orientation, such that ridge portion 110 may be substantially perpendicular to a top surface 112 of hollow body 102 (see, FIG. 1B). In another non-limiting example, ridge portion 110 may be integrally formed with hollow body 102 at a non-normal angle with respect to the top surface 112. Specifically, ridge portion may be formed in a substantially angled orientation such that ridge portion may not be perpendicular to top surface 112 of hollow body 102. As discussed in detail below, when grip sleeve 100 is positioned around a grip of a firearm, ridge portion 110 may be substantially angled and in some instances, may be angled in a similar orientation as the angle of the grip of the firearm.

Ridge portion 110 may extend over at least a portion of the height (H) of hollow body 102. In a non-limiting example shown in FIG. 1B, ridge portion 110 may extend over an entire height (H) of hollow body 102. By extending over the entire height (H) of hollow body 102, grip sleeve 100 may provide a user with the largest contact area and/or support on a firearm utilizing grip sleeve 100.

In another non-limiting example, ridge portion 110 may only extend over a portion of the height (H) of hollow body 102. In the non-limiting example, portions of hollow body 102 surrounding ridge portion 110 (e.g., portions of hollow body 102 positioned adjacent and above and/or below ridge portion 110) may substantially cover, fold over and/or prevent ridge portion 110 from being exposed when grip sleeve 100 is positioned on, placed around and/or coupled to a grip of a firearm. Covering and/or preventing exposure of ridge portion 110 may prolong the operational life of ridge portion 110 and grip sleeve 100, respectively.

The width (W) of ridge portion 110 of grip sleeve 100 may be substantially uniform. As shown in FIGS. 1A-1C, the width (W) of ridge portion 110 may be substantially uniform over the length of ridge portion 110 and/or over the entire height (H) of hollow body 102. In other non-limiting examples, the width (W) of ridge portion 110 may vary and/or change. For example, the width (W) of ridge portion 110 may gradually increase or decrease over the length of the ridge portion 110 as ridge portion 110 approaches top surface 112 of hollow body 102. In another non-limiting example, the width (W) of a central portion of ridge portion 110 may be greater than or less than a width (W) of distal portions of ridge portions 110 positioned on opposite sides of the central portion.

Grip sleeve 100 may be formed from a substantially elastic material. Specifically, hollow body 102 and ridge portion 110 forming grip sleeve 100 may be formed from an elastic material(s). In a non-limiting example, hollow body 102 and ridge portion 110 may be formed from a polymer material including, but not limited to, rubber, nylon, vinyl or any other suitable polymer/plastic material that include elastic properties. In addition to including elastic properties, the material forming at least a portion of grip sleeve 100 may also be substantially deformable and/or compressible. For example, at least one of hollow body 102 and/or ridge portion 110 may be formed from a material that may be deformable and may allow hollow body 102 and/or ridge portion 110 to be deformed when grip sleeve 100 is positioned around a grip for a firearm and gripped by a user of the firearm.

As shown in FIGS. 1A and 1C, hollow body 102 and ridge portion 110 may be formed from a similar or the same material. In a non-limiting example, both hollow body 102 and ridge portion 110 forming grip sleeve 100 may be formed from a synthetic rubber material that includes both elastic and deformable properties. In another non-limiting example, ridge portion 110 may be formed from a material distinct from the material forming hollow body 102. In a non-limiting example, hollow body 102 may be formed from a nylon material and ridge portion 110 may be formed from a rubber material. In the non-limiting example, ridge portion 110 may be more deformable and/or may have greater deformation capabilities than hollow body 102 as a result of the composition of each material forming the distinct portions of grip sleeve 100. In another non-limiting example, hollow body 102 and/or ridge portion 110 may include distinct materials within each component. That is, portions of hollow body 102 and/or ridge portion 110 may be formed from a first material that is compositionally different that a second material forming distinct portions of hollow body 102 and/or ridge portion 110.

Grip sleeve 100, and specifically hollow body 102 and ridge portion 110 may be formed using any suitable manufacturing process including, but not limited to, casting molding, thermoforming, and the like. The manufacturing process used to form grip sleeve 100 may be dependent, at least in part, on the material or materials used to form hollow body 102 and/or ridge portion 110.

Figure 2A:
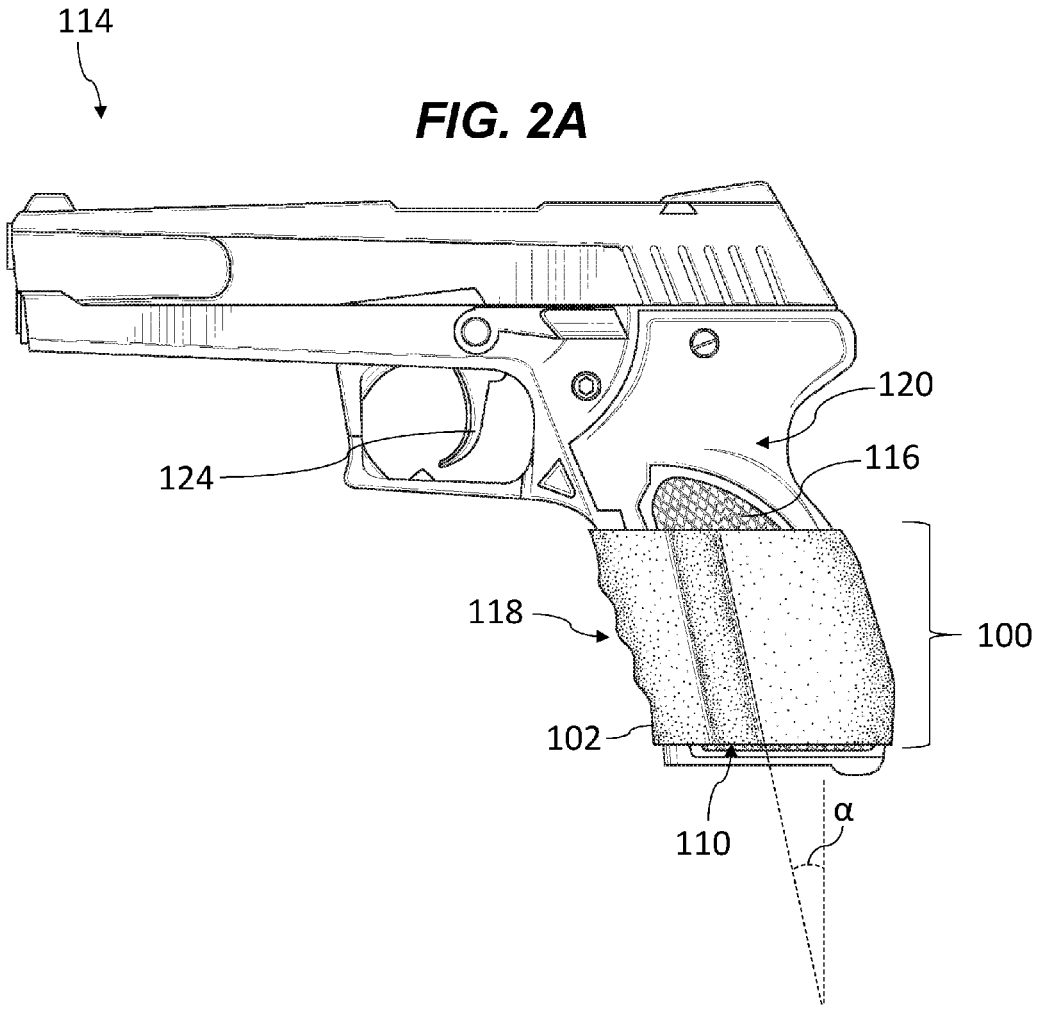
FIG. 2A shows an illustrative side view of a firearm and a grip sleeve positioned around a grip of the firearm, according to an embodiment.
Figure 2B:
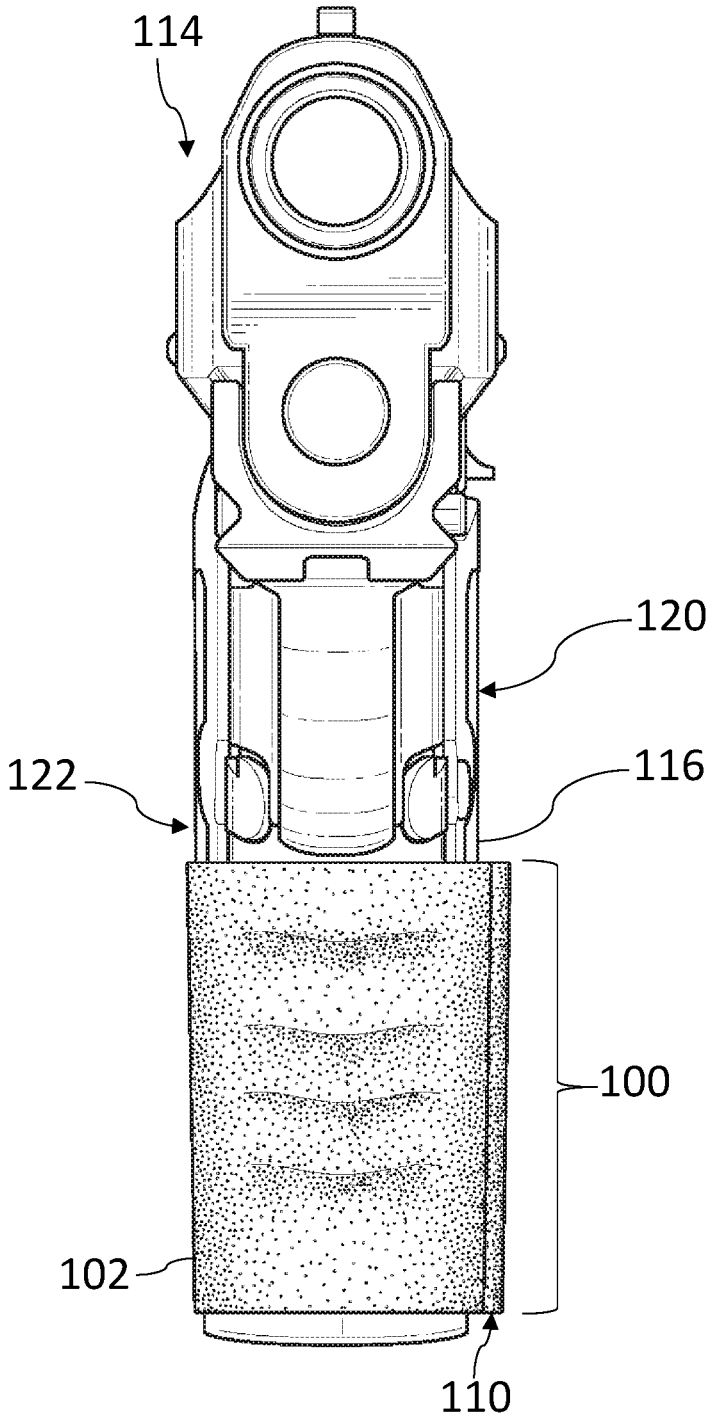
FIG. 2B shows an illustrative front view of the firearm and the grip sleeve positioned around the grip of the firearm shown in FIG. 2A, according to an embodiment.
Figure 2C:
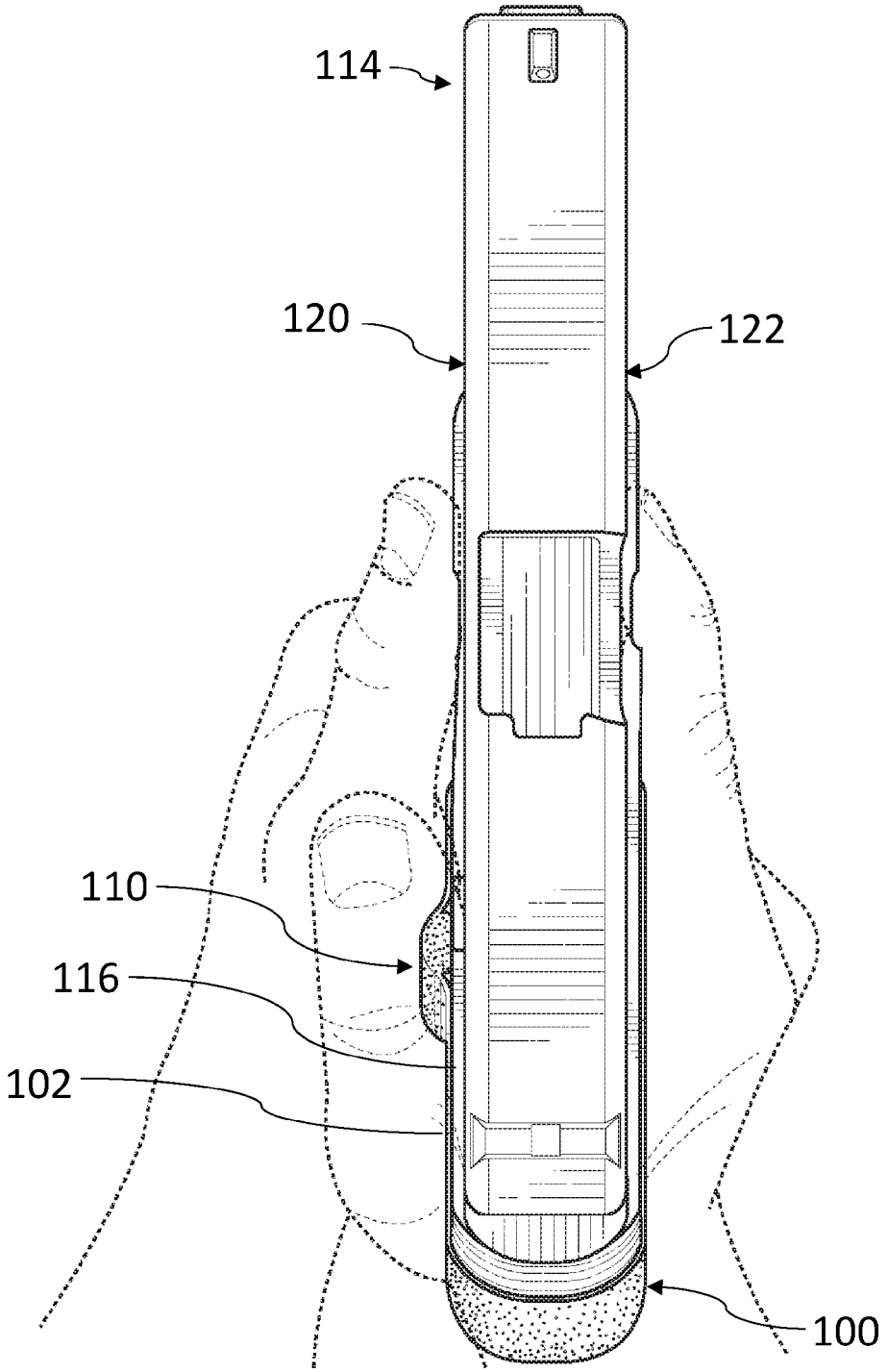
FIG. 2C shows an illustrative top view of the firearm and the grip sleeve positioned around the grip of the firearm shown in FIG. 2A, according to an embodiment.
Figure 3A:
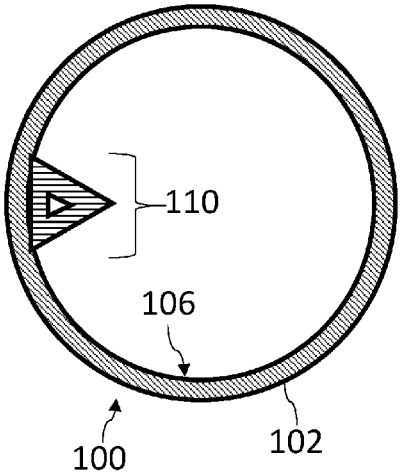
FIGS. 3A-3D show illustrative top views of grip sleeves for firearms, according to various embodiments.
Figure 3B:
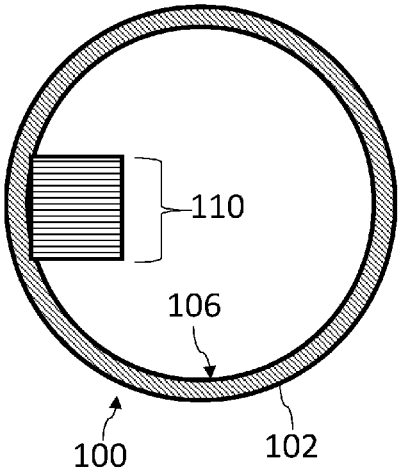
Figure 3C:
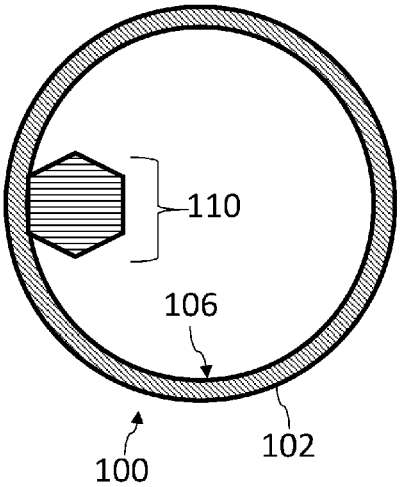
Figure 3D:
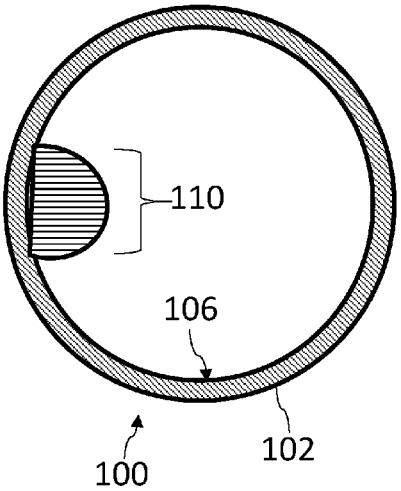

Turning to FIGS. 2A-2C, a firearm 114 is shown including grip sleeve 100. More specifically, grip sleeve 100 is positioned and/or placed around an angled grip 116 including finger grooves 118 of firearm 114. Inner contact surface 106 of hollow body 102 and ridge portion 110 may contact angled grip directly when grip sleeve 100 is positioned around angled grip 116 of firearm 114. Grip sleeve 100 may be installed and/or placed around angled grip 116 of firearm 114 by initially inserting angled grip 116 within interior space 104 of grip sleeve 100. Subsequently hollow body 102 may be pulled, moved, expanded and/or stretched over angled grip 116 until grip sleeve 100 is positioned in a desirable location on angled grip 116 of firearm 114. As shown in FIG. 2A, ridge portion 110 of grip sleeve 100 may be positioned and/or oriented over the majority of a side of angled grip 116 of firearm 114.

As a result of grip sleeve 100 being formed from substantially elastic material, hollow body 102 may stretch and/or move over angled grip 115 of firearm 114 without breaking and/or tearing. Additionally, the elastic properties of grip sleeve 100 may also aid in the retention of grip sleeve 100 on angled grip 116 of firearm 114. In a non-limiting example, the circumference of interior space 104 of grip sleeve 100 in an unstretched state may be substantially smaller than the circumference of angled grip 116 of firearm 114. In a more particular non-limiting example, the diameter of interior space 104 of grip sleeve 100 in an unstretched state may be 50 mm or less. In a still more particular non-limiting example, the diameter of interior space 104 of grip sleeve 100 in an unstretched state may be in a range of 25-46 mm, or 30-35 mm in an even more particular non-limiting example. As a result, when hollow body 102 of grip sleeve 100 is stretched and positioned around angled grip 116, grip sleeve 100 may contract around angled grip 116 and may be held in position via a compression fit. Finally, the elastic properties of the material forming grip sleeve 100 may also allow hollow body 102 to contour around finger grooves 118 of angle grip 116, and may not reduce the tactile finger support provided by finger grooves 118 to the user of firearm 114.

When grip sleeve 100 is coupled to and/or placed around angled grip 116 of firearm 114, ridge portion 110 of grip sleeve 110 may contact angled grip 116. Ridge portion 110 may also protrude and/or extend out or away from angled grip 116 because of the shape and/or configuration of ridge portion 110 and the compressive fit of grip sleeve 100 on angled grip 116. Additionally, and as shown in FIGS. 2B and 2C, when hollow body 102 of grip sleeve 100 is placed around angled grip 116, a portion of hollow body 102 positioned adjacent ridge portion 110 may extend away from angled grip 116 of firearm 114.

Ridge portion 110 and/or the portion of hollow body 102 positioned adjacent ridge portion 110 may extend away from angled grip 116 on a predetermined side of firearm 114. The predetermined side of firearm 114 may be dependent on the user's handgrip on firearm 114. Specifically, the user's hand grip and/or the user's shooting hand may determine the side of firearm 114 in which ridge portion 110 is positioned on when grip sleeve 100 is place around angled grip 116 of firearm 114. Ridge portion 110 may be positioned on a non-firing hand side 120 of firearm 114, as determined by the user and the user's hand place while operating or firing firearm 114. In the non-limiting example shown in FIGS. 2A-2C, the user of firearm 114 may use their right hand as their primary or firing hand. In the non-limiting example and as shown in FIG. 2C, the user may place his/her right hand on firearm 114, grip angled grip 116 on a firing hand side 122, and may place a finger of the firing hand on trigger 124 when firing firearm 114. As a result of the user's firing hand being the right hand, grip sleeve 100 may be positioned around angled grip 116 such that ridge portion 110 is position on the non-firing hand side 120 to engage user's non-firing hand or left hand. The user's left palm may contact, cover and/or be positioned on grip sleeve 100 and may abut and/or be pressed against the portion of hollow body 102 positioned adjacent ridge portion 110 that protrudes and/or extends away from angled grip 116. Ridge portion 110 extending from angled grip 116 may provide additional support and/or grip to the user's non-firing hand and may substantially prevent movement of the user's non-firing hand when firing or shooting firearm 114.

As shown in FIG. 2A, angled grip 116 of firearm 114 may be sloped or orient at an angle ($\alpha$) to aid in the comfort and/or grip of firearm 114. As a result of the positioning of grip sleeve 100 around angled grip 116, ridge portion 110 may also contour and/or be oriented to match the angle ($\alpha$) of angled grip 116. That is, when hollow body 102 is positioned or placed around angled grip 116, the substantially linear or planar shape of hollow body 102 and ridge portion 110 of grip sleeve 100, as previously shown in FIGS. 1A-1C, may be deformed and may take a similar shape, orientation and/or angle of angled grip 116 of firearm 114. Matching the angle ($\alpha$) of angled grip 116 with ridge portion 110 of grip sleeve 100 may provide further support and/or comfort to a user of firearm 114, and/or may aid in preventing movement of the user's non-firing hand when firing firearm 114.

Although discussed herein as being formed integrally and having a ridge portion 110 having an elliptical cross-section, it is understood that hollow body 102 and ridge portion 110 of grip sleeve 100 may be formed in various other configurations. Turning to FIGS. 3A-3D, a variety of grip sleeves 100 are shown according to various embodiments. As shown in FIGS. 3A-3D, hollow body 102 and ridge portion 110 may be formed from distinct components. Specifically, hollow body 102 and ridge portion 110 may be formed independent of one another, and may be permanently attached and/or coupled to one another after the formation of each individual component. As shown in FIGS. 3A-3D, ridge portion 110 may be permanently coupled or attached directly to inner contact surface 106 of hollow body 102. Ridge portion 110 may be coupled or attached to inner contact surface 106 using a variety of suitable coupling techniques and processes including, but not limited to, adhesive, melting, mechanical fasteners, and the like.

In another non-limiting example where hollow body 102 and ridge portion 110 are formed from distinct components, ridge portion 110 may not be permanently coupled to inner contact surface 106 of hollow body 102. In the non-limiting example, ridge portion 110 may be a separate component or portion that may be inserted between hollow body 102 of grip sleeve 100 and angled grip 116 of firearm 114 (see, FIG. 2A) after hollow body 102 is placed around angled grip 116. Ridge portion 110 may be inserted between hollow body 102 and angled grip 116 on the non-firing hand side 120 (see, FIG. 2A) as determined by the user, prior to the user griping and firing firearm 114. As discussed herein, the size of grip sleeve 100, elastic properties of the material forming hollow body 102 and/or compressive fit retaining grip sleeve 100 on angled grip 116 of firearm 114 may also aid in the retention of ridge portion 110 between hollow body 102 and angled grip 116.

Ridge portion 110 may take a variety of shapes and sizes. In non-limiting examples shown in FIGS. 3A-3D, ridge portion may take the shape of a triangle (FIG. 3A), a square or quadrilateral (FIG. 3B), a hexagon (FIG. 3C), semi-circle (FIG. 3D) and various other polygons or geometric shapes. Furthermore, when fabricated as a separate component, ridge portion 110 can be formed from any of a variety of materials. In a non-limiting example, the ridge portion 110 can be formed of a solid material, such as a hard plastic, which is subsequently coupled to the interior contact surface 106 of hollow body 102 using any solution. The variety or variations in material, size, and/or shape of ridge portion 110 may allow a user to find a sleeve grip 100 including ridge portion 110 that provides the most comfort and/or prevents the greatest amount of forward movement of a non-firing hand when operating firearm 114. In a non-limiting example where ridge portion 110 not permanently coupled to hollow body 102, various ridge portions 110 having varying materials, sizes, and/or shapes may be easily and rapidly interchanged based the preference of user of the firearm 114, the size and/or shape of angled grip 116 and/or the type of firearm 114 utilizing grip sleeve 100.

In addition to having a variety of shapes and sizes for ridge portion 110, it is understood that grip sleeve 100 may have a variety of sizes as well. Specifically, grip sleeves 100 may be manufactured to have a range of distinct sizes and/or heights for hollow body 102 to fit angled grips 116 for a variety of firearms 114. In another non-limiting example, grip sleeve 100 may be manufactured to have a single size and/or height, but may be readily cut, adjusted or shortened to fit a variety firearms 114 and/or to prevent obstruction of other portions (e.g., safety) of firearm 114.

Although shown and discussed as being formed on and/or extending from inner contact surface 106 of hollow body 102, it is understood that ridge portion 110 may be formed on, in, and/or extend from distinct portions of hollow body 102 of grip sleeve 100. In another non-limiting example, ridge portion 110 may be formed on, in, and/or extend from outer contact surface 108. In this non-limiting example, a majority of ridge portion 110 may extend outward and/or away from outer contact surface 108. Additionally, a portion of ridge portion 110 may also extend into interior space 104. In another non-limiting example, ridge portion 110 may be formed substantially in hollow body portion 102 and between inner contact surface 106 and outer contact surface 108. As such, the portion of ridge portion 110 extending away from inner contact surface 106 and/or into interior space 104 may extend the same distance as the portion of ridge portion 110 extending away from outer contact surface 108.

Although shown as a separate component for the angled grip of a firearm, it is understood that the aspects and features of the grip sleeve may be included directly on a firearm. Specifically, an angled grip of a firearm may include a ridge portion formed integrally with the angled grip on a side of the firearm. Like the grip sleeve discussed herein, the ridge portion formed integrally with the angled grip of the firearm may be angled in a similar orientation as the angle of the grip. In this case, the ridge portion can be formed of a solid or slightly deformable material, which is permanently affixed to the grip of the firearm. Forming the ridge portion integral with the grip of the firearm may provide similar benefits as the grip sleeve discussed herein, including the reduction in forward movement of a non-firing hand for a user of the firearm.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A grip sleeve for a firearm, the grip sleeve comprising:

a hollow body formed of an elastic material, the hollow body comprising:

an inner contact surface configured to be placed around a grip of the firearm; and an outer contact surface surrounding the inner contact surface; and a ridge portion configured to minimize or eliminate forward movement of a user's hand during use of the firearm, wherein the ridge portion extends linearly along a height of the hollow body, wherein the grip sleeve includes only one ridge portion, wherein the ridge portion has a thickness in a range of 8 mm to 15 mm, and wherein portions of the hollow body abutting opposing sides of the ridge portion have a thickness up to 2 mm.

2. The grip sleeve of claim 1, wherein the ridge portion forms a non-perpendicular angle to a top surface of the hollow body.

3. The grip sleeve of claim 1, wherein the ridge portion is integrally formed on the inner contact surface of the hollow body.

4. The grip sleeve of claim 1, wherein the ridge portion is coupled to the inner contact surface of the hollow body.

5. The grip sleeve of claim 4, wherein the ridge portion is formed from a same material as the hollow body.

6. The grip sleeve of claim 1, wherein the ridge portion extends over an entire height of the hollow body.

7. The grip sleeve of claim 1, wherein the ridge portion is formed from a deformable material.

8. The grip sleeve of claim 1, wherein the hollow body is cylindrical.

9. The grip sleeve of claim 1, wherein the ridge portion causes a corresponding region of the outer contact surface to extend outward and form an elongate ridge protruding from a lateral side of the grip when the hollow body is placed around the grip.

10. The grip sleeve of claim 1, wherein the ridge portion extends from the inner contact surface into an interior space of the hollow body.

11. A grip sleeve for a firearm, the grip sleeve comprising:

a hollow body formed from an elastic material, wherein the hollow body is configured to be placed around at least a portion of an angled grip of the firearm; and a ridge portion configured to minimize or eliminate forward movement of a user's hand during use of the firearm, wherein the grip sleeve includes only one ridge portion, and wherein the ridge portion is configured to contact a lateral side of the angled grip of the firearm and form a linear elongate ridge protruding from the lateral side of the grip, wherein the ridge portion is angled to match an angle of the angled grip of the firearm when the hollow body is placed around the angled grip of the firearm, wherein the ridge portion has a thickness in a range of 8 mm to 15 mm, and wherein portions of the hollow body abutting opposing sides of the ridge portion have a thickness up to 2 mm.

12. The grip sleeve of claim 11, wherein a portion of the hollow body positioned adjacent to the ridge portion extends away from the angled grip of the firearm when the hollow body is placed around the angled grip of the firearm.

13. The grip sleeve of claim 11, wherein the hollow body is held in position on the portion of the angled grip of the handgun via a compression fit.

14. The grip sleeve of claim 11, wherein the ridge portion extends from an inner contact surface into an interior space of the hollow body.

15. The grip sleeve of claim 11, wherein the thickness of the ridge portion is uniform.

16. A firearm comprising:

a grip of the firearm;

a grip sleeve surrounding at least a portion of the grip, wherein the grip sleeve includes a hollow body formed of an elastic material, the hollow body comprising:

an inner contact surface configured to be placed around the grip of the firearm; and an outer contact surface surrounding the inner contact surface; and only one ridge portion configured to minimize or eliminate forward movement of a user's hand during use of the firearm, wherein the ridge portion extends linearly along a height of the hollow body, wherein the ridge portion forms an elongate ridge protruding from a lateral side of the grip, and wherein the ridge portion is held in place by the grip sleeve, wherein the ridge portion has a thickness in a range of 8 mm to 15 mm, and wherein portions of the hollow body abutting opposing sides of the ridge portion have a thickness up to 2 mm.

17. The firearm of claim 16, wherein the grip sleeve and the ridge portion are formed of an integral material.

18. The firearm of claim 16, wherein the ridge portion has an elliptical cross-section.

19. The firearm of claim 16, wherein the ridge portion is permanently attached to the grip sleeve.

20. The firearm of claim 16, wherein the ridge portion is located to engage a palm of a non-firing hand of a user of the firearm.

* * * * *